US006458262B1

(12) United States Patent
Reid

(10) Patent No.: US 6,458,262 B1
(45) Date of Patent: Oct. 1, 2002

(54) ELECTROPLATING CHEMISTRY ON-LINE MONITORING AND CONTROL SYSTEM

(75) Inventor: Jonathan David Reid, Sherwood, OR (US)

(73) Assignee: Novellus Systems, Inc., San Jose, CA (US)

( * ) Notice: Subject to any disclaimer, the term of this patent is extended or adjusted under 35 U.S.C. 154(b) by 53 days.

(21) Appl. No.: 09/802,490

(22) Filed: Mar. 9, 2001

(51) Int. Cl.[7] ..... C25D 21/14

(52) U.S. Cl. ..... 205/82; 204/228.6; 204/229.2; 204/232; 204/237; 205/101

(58) Field of Search ..... 205/82, 99, 101; 204/228.1, 228.6, 229.2, 232, 237, DIG. 13

(56) References Cited

U.S. PATENT DOCUMENTS 4,102,756 A * 7/1978 Castellani et al. ..... 204/43 T
5,352,350 A 10/1994 Andricacos et al.
5,368,715 A * 11/1994 Hurley et al. ..... 205/82
6,024,856 A * 2/2000 Haydu et al. ..... 205/84
6,254,760 B1 * 7/2001 Shen et al. ..... 205/335

OTHER PUBLICATIONS

Taylor, et al, "Electroplating bath control for copper interconnects", Solid State Technology, Nov. 1998, pp. 47–57.

Wikiel, et al., "On–Line Monitoring of Chemical Processes in Electronic Components Manufacturing", Technic, Inc., pp. 1–8. Date of Publication Not Available.

Paar, Anton, "L–DENS–Liquid Density Transmitter for OEM Applications (Original Equipment Manufacturer)", Instruction Book, Mar. 12, 1996, pp. 1–30.

"Quali–Line™ AC–1000", ECI Technology, 1993, pp. 1–2.

Bratin, Peter, "New Development in the Use of Cyclic Voltammetric Stripping for Analysis of Plating Solutions", pp. N1–N28. ( Date of Publication Not Available).

"Real Time Analyzer (RTA) Technical Manual", Technic, of Providence, Rhode Island, pp. 1–19. Date of Publication Not Available.

* cited by examiner

*Primary Examiner*—Nam Nguyen
*Assistant Examiner*—William T. Leader
(74) *Attorney, Agent, or Firm*—Beyer Weaver & Thomas, LLP

(57) ABSTRACT

The present invention provides methods and apparatus for analysis and monitoring of electrolyte bath composition. Based on analysis results, the invention controls electrolyte bath composition and plating hardware. Thus, the invention provides control of electroplating processes based on plating bath composition data. The invention accomplishes this by incorporating accurate bath component analysis data into a feedback control mechanism for electroplating. Bath electrolyte is treated and analyzed in a flow-through system in order to identify plating bath component concentrations and based on the results, the plating bath formulation and plating process are controlled.

36 Claims, 5 Drawing Sheets

ELECTROPLATING CHEMISTRY ON-LINE MONITORING AND CONTROL SYSTEM

FIELD OF THE INVENTION

This invention relates to silicon wafer electroplating and quantitative analysis of electroplating bath components. More specifically, it relates to analysis of electroplating bath constituents during integrated circuit fabrication. Even more specifically, the invention pertains to a particular monitoring and feedback system used for analysis and control of electroplating bath formulations and plating hardware.

BACKGROUND OF THE INVENTION

Improved integrated circuit fabrication processes continue to necessitate more complex and demanding control of process parameters to ensure wafer uniformity and quality. Electroplating is a good example. Electroplating for integrated circuit fabrication is typically performed in a series of plating steps, with each having a particular hardware configuration and specific plating bath formulation. Often bath formulations include metal salts, acids, and organic additives. More than ever, it is critical to monitor plating bath electrolyte constituents and maintain bath formulations within a specific range of parameters to ensure the desired outcome and quality of a particular plating process.

Conventional methods of assaying bath constituents commonly employ cyclic voltammetric stripping (CVS) or other forms of Faradaic electroanalysis, which have limitations in specificity and sensitivity. For example, voltammetric analyses suffer from lack of detection capability for compounds and ions that are not electrochemically active over the range of potentials used. Additionally, voltammetric analyses are sensitivity-limited by matrix effects (convoluted electrochemical interactions due to the response of breakdown products).

High-pressure liquid chromatography (HPLC) has been proposed as a method to monitor plating bath constituents by Taylor et al. "Electroplating Bath Control for Copper Interconnects," *Solid State Technology*, vol. 4, issue Nov. 11, 1998. In this article, the authors describe using HPLC to separate electrolyte species. Although HPLC techniques have improved dramatically over the past decade, this type of analysis has limitations with regard to plating bath composition. While organic additives such as accelerators, suppressors, and levelers are well suited for chromatographic separation, some important primary bath species, ions, metal salts, and acids are not. Analysis of purified bath components via chromatography can provide valuable information about organic plating bath electrolyte components, but only provides a partial picture of the plating environment.

Another problem associated with conventional plating bath analysis is time, or more specifically turnaround. Although analysis techniques have improved to include shorter analysis time frames, the time necessary for conventional analyses as compared to the time frame of possible change in a plating bath composition can be inadequate. Presently, concentrations of most chemicals in plating baths are measured by removing a sample from the bath and performing an analysis in a remote lab. Although these "off-line" measurements made in a separate lab are cost effective and reliable, the turnaround is often unacceptable for monitoring and controlling production equipment. Under such conditions, data regarding composition change obtained from plating bath analysis is rendered useless because the data may no longer reflect the actual bath formulation. This can be particularly problematic when such data is used to adjust bath component stoichiometries, i.e. the stoichiometry imbalance noted in the analysis can be compounded by addition of bath components based on inaccurate data.

An improved approach toward monitoring electrolyte composition is "on-line" monitoring; that is, using a system that is integral to plating production hardware and is continually supplied with electrolyte sample for time efficient regular feedback to the plating system. Existing on-line monitoring systems for plating baths rely on titration of bath samples or cyclic voltammetry.

An example of an "on-line" analyzer that uses cyclic voltammetry is the QUALI-LINE AC-1000, from ECI Technology of East Rutherford, N.J. This system has a relatively small footprint, but voltammetric methods suffer the drawbacks as described above. A more elegant approach is utilized by Technic, of Providence, R.I. with their RTA (real time analyzer) system. The RTA uses a probe that is immersed directly into a plating bath electrolyte. Although this system is very simple, and a good monitoring tool, the data obtained from cyclic voltammetry methods is not as accurate or reliable as desired for modem production plating environments.

Systems utilizing "on-line" titration methods also have drawbacks. First, each titration requires one or more chemical reactants that are used only once with the sample being analyzed. These chemicals must be replenished. Second, detection of an endpoint for a titration usually requires an electrode that must be frequently calibrated. Third, such systems have large footprints, due to the syringe assemblies and reservoirs supplying the assemblies. Finally, titrations produce waste, which results in disposal issues.

Another alternative for on-line monitoring is ion chromatography. Besides having large waste streams, this method uses relatively expensive equipment and is of questionable reliability.

What is needed therefore is improved technology for on-line analysis and control of electroplating bath formulations during electroplating and electroplating processes during integrated circuit fabrication.

SUMMARY OF THE INVENTION

The present invention provides methods and apparatus for analysis and monitoring of electrolyte bath composition. Based on analysis results, the invention controls electrolyte bath composition and plating hardware. Thus, the invention provides control of electroplating processes based on plating bath composition data. The invention accomplishes this by incorporating accurate bath component analysis data into a feedback control mechanism for electroplating. Bath electrolyte is treated and analyzed in a flow-through system in order to identify plating bath component concentrations and based on the results, the plating bath formulation and plating process are controlled.

One aspect of the invention pertains to methods for monitoring and controlling an electroplating process. These methods may be characterized by the following sequence: (a) obtaining a sample of electrolyte, comprising an acid, a metal salt, and one or more organic components, from the electroplating process; (b) removing an organic fraction of the sample of electrolyte to give a substantially organic-free electrolyte sample; (c) determining the density of the substantially organic-free electrolyte sample; (d) determining at least one of the conductivity and the light absorption of the substantially organic-free electrolyte sample; (e) comparing at least one of the conductivity and the light absorption measurement of the substantially organic-free electrolyte sample with the density in order to determine a concentration value for each of the metal salt and the acid; and (f) adjusting conditions of the electroplating process in response to a comparison of the concentration value for each of the metal salt and the acid, with an associated target value. Methods of the invention can monitor plating bath chemistries "on-line," that is, during the plating process in real time.

In these methods, the sample of electrolyte is obtained directly from a plating cell of the electroplating process, from a separate sampling vessel of the electroplating process, or from a central plating chemistry vessel.

Methods of the invention find particular use in the context of copper electroplating in a damascene scenario. In damascene copper electroplating, typically copper sulfate, sulfuric acid systems are used. Organic agents are often added to impart leveling, suppressing, or accelerating elements to the plating environment. As well, other inorganic additives may be added such as chloride ion, in the form of hydrochloric acid.

In the latter case, additionally such methods would include determining a chloride ion concentration (preferably after the metal salt and acid concentration determinations), and adjusting the plating process accordingly with respect to a comparison of the chloride ion concentration with an associated target value.

In a preferred embodiment, removing an organic fraction of the sample of electrolyte typically includes a filtration of the electrolyte through a charcoal medium, molecular sieves or other agent specific for removing only organic species. In one embodiment, the used filter agent (typically in a cartridge or module format) is exchanged for new periodically. In an alternative embodiment, the organic fraction is removed from the on-line system, stripped from the filter agent, and analyzed by HPLC. Results from this analysis are also used as a basis for adjusting electroplating conditions based on comparison with target values. Thus, after HPLC analysis of the organic fraction, an adjustment of the electroplating process with respect to a comparison of at least one concentration of an organic bath constituent, obtained from the HPLC analysis, with a target concentration value for the organic bath constituent is made.

Adjusting conditions of the electroplating process comprises adjusting electroplating apparatus hardware. Preferably, this is done through addition of chemical stocks to a central electroplating bath chemistry vessel. Based on data from comparing analysis results to target values, chemical feedstock valves are opened and chemicals metered into a central bath to adjust plating bath chemistry. After analysis, the electrolyte samples are returned to the central electroplating bath chemistry vessel. Alternatively, adjusting conditions of the electroplating process comprises manipulating other electroplating apparatus hardware or functions, such as electrical current flow to a plating cell, adjusting a field shaping apparatus, adjusting a voltage level, adjusting a wafer handling apparatus, adjusting a relative orientation of an electrode with a counter electrode, and the like.

Other embodiments of the invention relate to apparatus for performing the method of the invention. Such apparatus comprising: (a) a device for sampling electrolyte from the electroplating process, wherein the electrolyte comprises an acid, a metal salt, and one or more organic components; (b) a module for removing an organic fraction from the electrolyte to give a substantially organic-free electrolyte sample; (c) a densimeter for determining a density of the substantially organic-free electrolyte sample; (d) a module for determining at least one of conductivity and light absorption for the substantially organic-free electrolyte sample; and (e) an associated logic for using at least one of the conductivity and the light absorption in the substantially organic-free electrolyte sample and the density measurement in order to determine a concentration value for each of the acid and the metal salt and controlling the electroplating process based on comparison of the concentration value for each of the metal salt and the acid, with an associated target value.

The device for sampling electrolyte can collect electrolyte directly from a plating cell of the electroplating process, from a separate sampling vessel of the electroplating process, or from a central plating chemistry vessel. In one embodiment the device for sampling electrolyte is a pump. Preferably, the pump delivers electrolyte at between about 1 and 20 ml/minute through the analysis system.

The module for removing an organic fraction from the electrolyte typically uses a charcoal medium as an organic adsorbent, however, molecular sieves or other adsorbent specific for removing only organic species can be used. In one embodiment, the module for removing an organic fraction from the electrolyte isolates the organic fraction for delivery to and subsequent HPLC analysis in, an HPLC module. Delivery of the isolated organic fraction to the HPLC module is done through standard plumbing and valves well known to those skilled in the art.

Once filtered, the substantially organic free electrolyte is pumped through the system to a densimeter. The densimeter used for the invention can be from a commercial source as long as a density measurement for the substantially organic-free electrolyte sample is made to within an accuracy of 0.0001 g/cm$^3$.

After a density value for the electrolyte is determined, either the conductivity or the light absorption (or both) is determined. Apparatus for making the conductivity measurement and light absorption measurement preferably can determine a concentration value for each of the metal salt and the acid used in the electrolyte to within an accuracy of 0.1 g/L. The light absorption (absorptivity, extinction coefficient) is measured at a particular wavelength associated with determining concentration values most accurately. These components can be combined in a single module for determining at least one of the conductivity and the light absorption. Alternatively, either a spectrophotometer or conductivity cell would suffice to perform the method. In any case, flow-through systems are preferred.

At this point the associated logic compares at least one of conductivity and light absorption for at least one of the metal salt and the acid in the substantially organic-free electrolyte sample to the density of the substantially organic-free electrolyte sample in order to determine a concentration value for each of the metal salt and the acid. Based on a comparison of the concentration values for each of the metal salt and the acid with associated target values, the logic controls the electroplating process via manipulation of plating hardware.

The electrolyte can be returned to its plating hardware source at this time via a return line, or alternatively the electrolyte may travel through an additional apparatus in the on-line system and then returned. The alternative additional apparatus is a module for determining a chloride ion concentration measurement from the substantially organic-free electrolyte sample. If this apparatus is used, the chloride ion concentration measurement is also used as a basis for controlling the electroplating process by the associated logic. The chloride ion concentration measurement involves electrochemical oxidation of chloride ion to chlorine gas. Electrochemical cells to perform this analysis are common in the art.

Another aspect of this invention pertains to the logic associated with using plating species concentration data for feedback control of an electroplating process. Preferably data from an analysis is stored in a memory device. Then the data is compared to a data set of known target values for optimum plating performance. The comparison comprises determining whether the data from the on-line analysis falls within a specified tolerance of a target value. From the comparison, the logic determines commands for controlling the electroplating process. As mentioned, the invention finds particular use in the context of copper electroplating. Copper electroplating during damascene processing is becoming increasingly important and complex. The logic of the invention provides an efficient method of monitoring and controlling plating bath chemistry and hardware during electroplating. This allows for improvement in throughput and wafer uniformity.

Yet another aspect of this invention pertains to apparatus for controlling an electroplating process. Preferably, the control element comes in the form of commands sent to plating hardware by the logic as a result of a comparison of data from on-line analysis to target values. The associated logic of the apparatus controls plating hardware through adjustment, for example valves for introducing plating bath constituents and formulations, electric field shaping apparatus, current flow, voltage levels, wafer handling apparatus, and electrode movement apparatus. In many cases, individual components of the apparatus can be purchased commercially. Their configuration and programming constitute novelty in this case. The associated logic may be implemented in any suitable manner. Often it will be implemented in computer hardware and associated software for controlling the operation of the computer.

These and other features and advantages of the present invention will be described in more detail below with reference to the associated figures.

BRIEF DESCRIPTION OF THE DRAWINGS

The following detailed description can be more fully understood when considered in conjunction with the drawings in which.

DETAILED DESCRIPTION OF THE PREFERRED EMBODIMENTS

In the following detailed description of the present invention, numerous specific embodiments are set forth in order to provide a thorough understanding of the invention. However, as will be apparent to those skilled in the art, the present invention may be practiced without resort to some of these specific details or by using alternate elements or processes. For example, removal of an organic fraction from an electrolyte sample might involve a separator other than those mentioned herein, like a bi-phasic liquid extractor. In some descriptions herein, well-known processes, procedures, and components have not been described in detail so as not to unnecessarily obscure aspects of the present invention.

Figure 1:
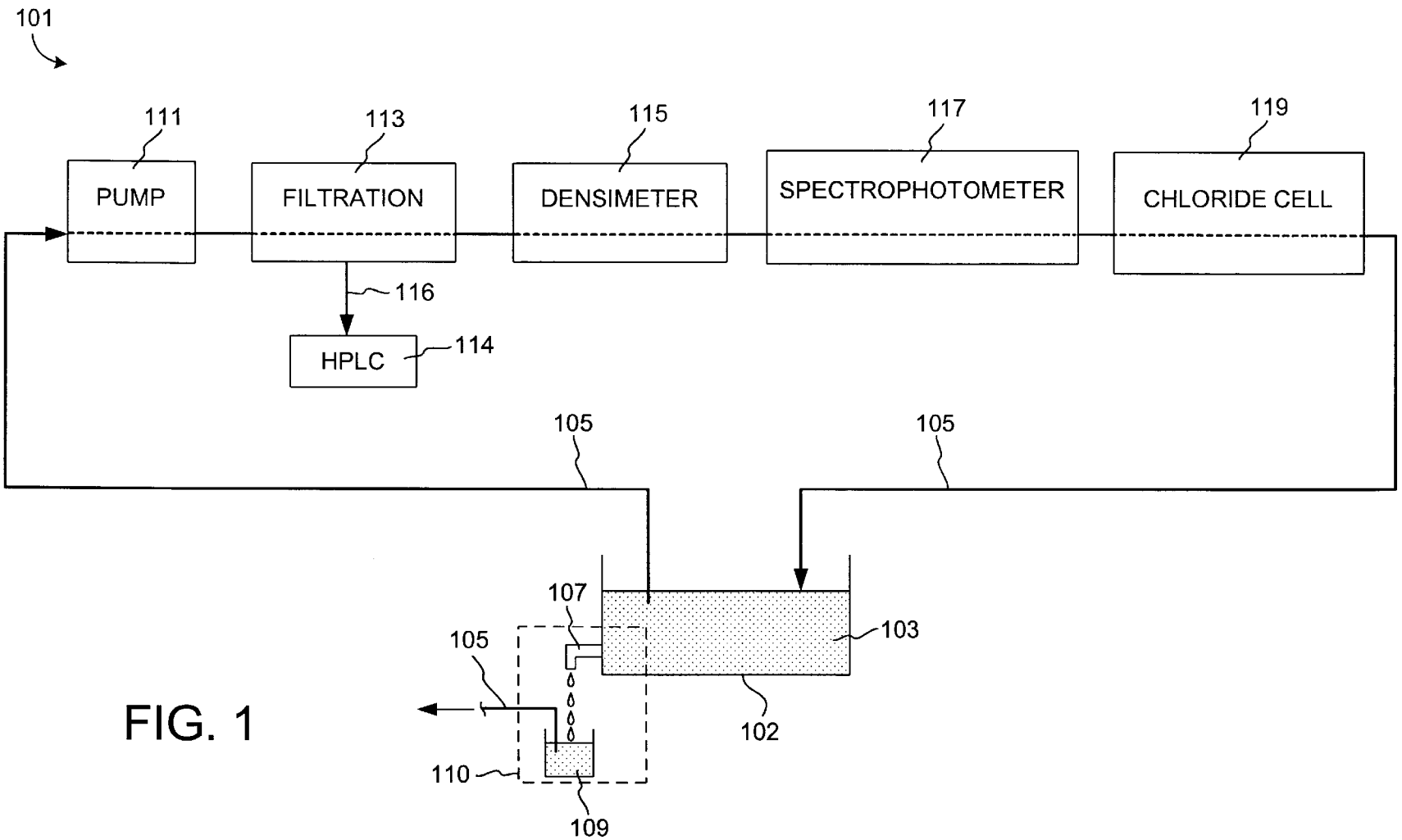
FIG. 1 depicts a block diagram of an on-line analysis system of the invention.

Aspects of the invention feature a method for monitoring electrolyte plating bath chemistry and providing feedback to an electroplating apparatus for the purpose of adjusting bath components and controlling the plating process. FIG. 1 depicts a block diagram of an on-line analysis system, 101, of the invention. This system is integral to the plating system to which it is associated, so that the plating process can be monitored continually during operation of the plating system. Preferably it is a flow-through system, wherein electrolyte is continually passed through for analysis.

Electrolyte bath 102 contains electrolyte 103. Bath 102 is typically a centralized plating chemistry mixing vessel that supplies plating cells with electrolyte. Alternatively, 102 could be a plating cell or cells. The invention can be implemented for parallel analysis of multiple cells, given that all of the individual components of the system can be configured for parallel analysis runs. Feed and return line 105 represents a conduit that electrolyte 103 follows as it pumped from vessel 102, through the analysis system, and returned to 102, as depicted. Line 105 is represented with portions shown as dotted lines, indicating that 105 is continuous through the individual components of the system. In practical terms, line 105 is composed of a material that is resistant to the corrosive electrolyte. One skilled in the art would understand that individual components of the system would normally have their own sample inlet, internal plumbing, analysis cells, and sample outlets (also resistant to the corrosive properties of the electrolyte). In FIG. 1 these are depicted as being integral, and thus 105 is functionally continuous. Alternatively, feed and return line 105 may receive electrolyte from vessel 102 via a separate sampling vessel 109, fed from gravity drip outlet 107 (as depicted within dashed line rectangle 110). In the latter case, the electrolyte sample is returned to vessel 102 after analysis.

Electrolyte 103 is pumped through the on-line analysis system by pump 111. Pump 111 can be commercially available. Preferably, pump 111 delivers electrolyte at between about 1 and 20 ml/minute through the analysis system.

Once electrolyte passes through pump 111, it moves on to filtration module 113. Filtration module 113 typically uses a charcoal medium as an organic adsorbent. However, molecular sieves or other adsorbents (organic or inorganic) specific for removing only organic species can be used. Examples would be the "Carbon-XP" granular charcoal filter from Serfilco, of Northbrook, Ill. Preferably, the adsorbent removes sulfur-containing organic species, as these can interfere with accurate analysis by other parts of the system. In a preferred embodiment, filtration module 113 can be a simple charcoal cartridge-type filter that can be easily changed during operation of the system.

In one embodiment, the filtration module isolates the organic fraction for subsequent HPLC analysis. The isolated organic fraction is delivered to HPLC 114 (module), via line 116 using standard valves and plumbing known to those skilled in the art.

Once filtered, the substantially organic free electrolyte travels through system 101 to densimeter 115. Densimeter 115 can be from a commercial source such as the "L-DENS" apparatus, available from Anton-Par, of Graz, Austria. Such apparatus typically use a mass flow meter which uses a resonance frequency shift to measure the density of the electrolyte. However, densimeter 115 is not limited to this technique. Preferably, densimeter 113 can supply a density measurement for the substantially organic-free electrolyte sample to within an accuracy of 0.0001 g/cm$^3$. In typical acid copper baths, the density of the electrolyte is in the range of 1.1–1.2 g/cm$^3$ as a result of the addition of sulfuric acid and copper sulfate to water. Such accuracy in density measurement, along with the density change associated with acid or copper sulfate concentration changes in the bath, allow individual acid and copper concentrations determinations with an accuracy of the order of +/−0.1 g/L. To determine the concentration of, either component, a second independent measurement responding differentially to either the acid or the copper species concentrations must be made.

Once a density value for the electrolyte is determined, either a conductivity measurement or a light absorption measurement (or both) is made. FIG. 1 depicts a spectrophotometer, 117, as the next component in the analysis system. As mentioned above, either apparatus for making a conductivity measurement or a light absorption measurement can be used for 117. Alternatively, both can be combined within a single module for determining a conductivity measurement, a light absorption measurement, or both.

Conductivity cells are typically used to make conductivity measurements embodied in the invention. Conductivity responds to acid and copper levels differently than density, allowing construction of a matrix or set of equations which describe a unique set of conductivity and density values for a given copper and sulfuric acid content of a solution. Again, preferably a conductivity cell of the invention would be a flow-through system. Preferably a conductivity cell of the invention can determine a concentration value for each of the metal salt and the acid used in the electrolyte to within an accuracy of 0.1 g/L. Commercially available examples of conductivity cells suited for this purpose are the P-19500-30, available from Cole Parmer of Vernon Hills Ill., and the like.

In the example embodiment 101, spectrophotometer 117 is preferably a dual-beam fiber optic spectrophotometer. In such apparatus, two identical light beams are created; one is passed through the electrolyte sample, while the other is passed through a static reference sample in an identical cell. Response of the sample cell relative to the reference value is continuously used to compensate for any light source or detector variability. Alternatively a single beam spectrophotometer may be used with periodic calibration. Preferably, light absorption at a light wavelength of 814 nm is used to measure directly the copper concentration in the electrolyte sample. This allows for back calculation of acid concentration from the density measurement obtained from densimeter 115. Preferably a spectrophotometer of the invention can determine a concentration value for the metal used in the electrolyte to within an accuracy of 0.1 g/L. Commercially available examples of spectrophotometers suited for this purpose are the 20 Genesys Spectrophotometer, available from Thermo Spectronic of Rochester N.Y., and the like.

In one embodiment of the invention, the electrolyte is returned to vessel 102 at this point. Measuring only the concentrations of metal and acid in a plating bath quickly and accurately in an on-line system for feedback control is a powerful tool, especially in production settings. However, in this embodiment, an additional analysis cell is added to system 101. Commonly, chloride ion is added to electrolyte mixtures in the form of hydrochloric acid. Chloride ion is added to copper sulfate based plating baths to increase the adsorption strength of polyethylene glycol type suppressors, thus chloride concentration is an important parameter in plating bath chemistry. In this example, after the electrolyte sample passes through spectrophotometer 117, it flows into chloride cell 119 for measurement of the chloride ion concentration. Chloride cell 119 is an electrochemical cell in which chloride ion concentration is determined via electrochemical oxidation of chloride ion to chlorine gas, as depicted in the following equation. Chloride concentration in the electrolyte is directly $$2Cl^- \rightarrow Cl_2 + 2e^-$$

related to the number of electrons passed in the oxidation reaction in cell 119. This electrochemical reaction is well known and observed in routine current-voltage scans of acid copper plating baths. Normally, the oxidation of chloride can not be used to make an accurate measurement of its concentration because various organic additives (especially sulfur-containing organic species) present in the electrolyte oxidize at or near the same potentials as the chloride ion. In this invention however, the organics have been removed by filtration module 113 allowing direct chloride ion concentration measurement. Equipment readily available for this type of measurement include electrochemical detector cells and potentiostatic control equipment for chromatographic analysis. Commercially available examples of electrochemical cells suited for this purpose are the ED40 Electrochemical Detector, available from Dionex of Sunnyvale Calif., and the like. After analysis the electrolyte sample is returned to vessel 102 via 105. In this case, chloride ion concentration is also used for feedback control of a plating process.

Figure 2:
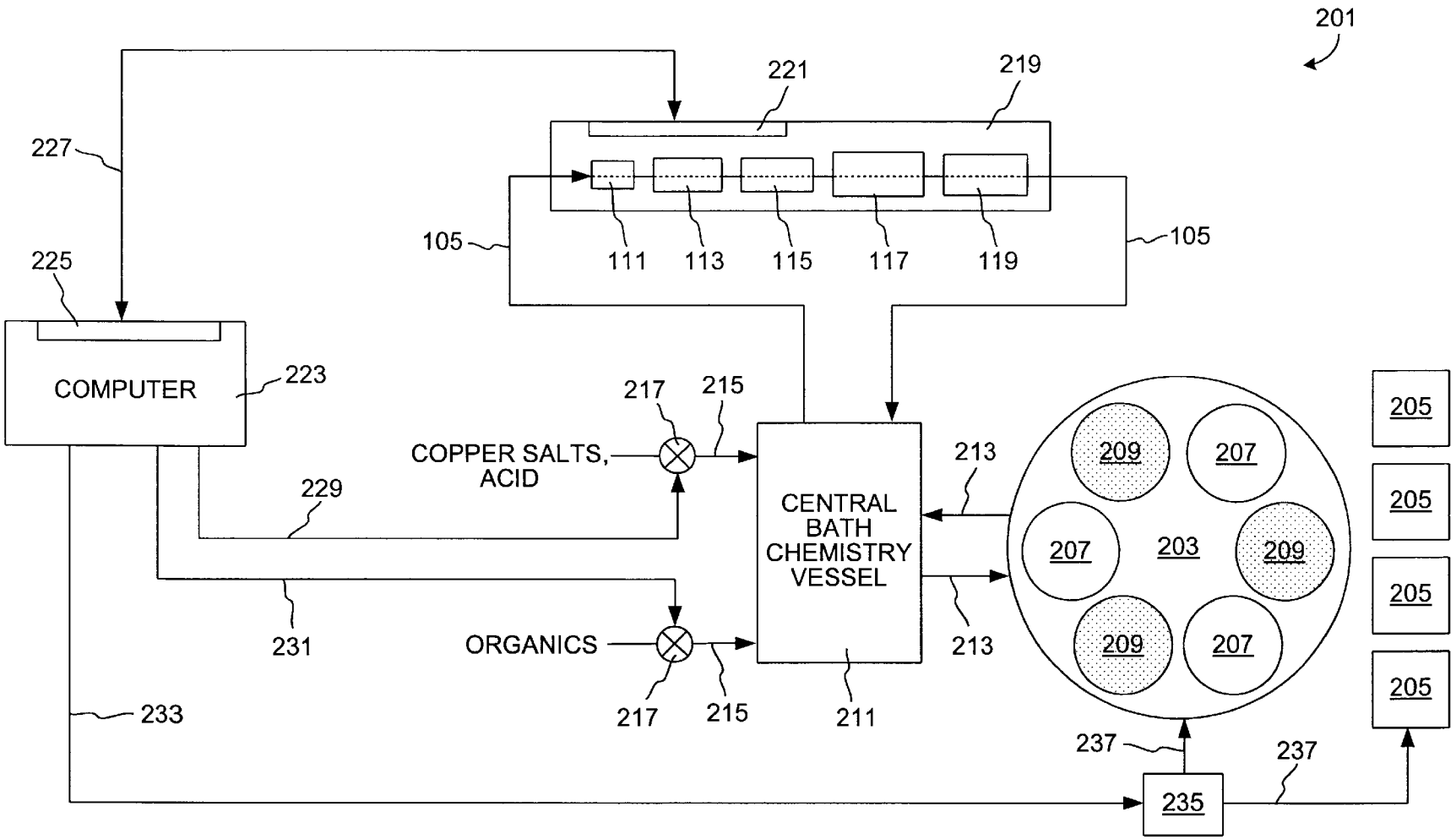
FIG. 2 depicts a block diagram of a hardware configuration used to perform the method of the invention.

FIG. 2 depicts a block diagram of a hardware configuration 201 that can be used to perform the method of the invention. An electroplating apparatus 203 (such as the SABRE™ clamshell electroplating apparatus available from Novellus Systems, Inc. of San Jose, Calif.) has wafer loading stations 205, three rinse-EBR (edge bevel removal) stations 207, and three electroplating cells 209. Electroplating cells 209 are typically configured to electroplate three silicon wafers simultaneously. Chemistry vessel 211 is a centralized mixing chamber for pre-mixing electrolyte formulations. Electrolyte is circulated to plating cells 209, via circulation lines 213 (circulation pump not depicted). In this embodiment of the invention, 211 is fitted with feed and return line 105 as described above for FIG. 1. Vessel 211 is sampled using apparatus as described in FIG. 1, for example. Line 105 feeds bath electrolyte to on-line analysis system 219, which in this case is essentially system 101 from FIG. 1, where components 111, 113, 115, 117, and 119 are contained in a housing. On-line analysis system 219 contains a communication bus 221 for two-way communication between components 111, 113, 115, 117, and 119 with computer 223 via bus 225 and communication line 227.

Computer 223 processes input electrolyte composition data and controls plating hardware via communication lines 229, 231, and 233; thus completing the communication feedback component of the invention. Thus, computer 223 is a serves as a system controller for the electroplating process. Communication lines 229 and 231 are used to send commands from computer 223 to control valves 217, which in turn control the flow of bath constituents (copper salts, acid, organics, etc.) into central bath chemistry vessel 211, via feed lines 215; thus completing the control component of the invention. Communication line 233 connects computer 223 with a communication bus 235. Bus 235 feeds commands to plating hardware (not shown) to toggle power source switches, adjust plating currents, load/unload wafers, etc. through communication lines 237. Thus, computer 223 is a system controller for the plating apparatus and process.

In this case, data collected from analysis of an electrolyte sample from 219 is used to determine what plating hardware or electrolyte parameters, if any, need adjustment. The logic of the invention compares electrolyte species concentration data to known target values and based on the comparison, commands plating hardware to perform specific tasks. For example, if data is found to closely match a target value (which is representative of the desired bath formulation for optimal electroplating), then plating hardware can be instructed (via 235) to continue plating or to cease electroplating after a pre-set time period has ended. If data from a run is found to closely match another target value (which is representative of a poor bath formulation), then plating hardware can be instructed (via 235) to cease electroplating immediately. Alternatively, if data from a run is found to closely match yet another target value (which is representative of a non-optimal but acceptable bath formulation for electroplating), then plating hardware can be instructed to continue electroplating, but adjust the plating bath formulation (via 211). Alternatively, commands to plating hardware might include adjusting current flow, field shaping apparatus, voltage levels, distance between anode and cathode, rotation rate of the anode or cathode, electrolyte flow characteristics (if any), and the like.

The data output by system 219 can also be used to manually adjust the composition of the plating bath, without resort to specific stored target data. However, it will typically be more computationally efficient to simply compare sample data against one or more known target standards for unique plating bath compositions.

Any number of plating hardware feedback control scenarios can be used with this invention. The on-line analysis system of the invention provides fast, accurate, and meaningful analysis of plating bath constituent concentrations. By incorporating this type of analysis into plating bath hardware configurations, the invention achieves an efficient feedback control mechanism and improves wafer process uniformity and throughput. The feedback control method of the invention can be applied to other wafer wet processes as well.

Figure 3:
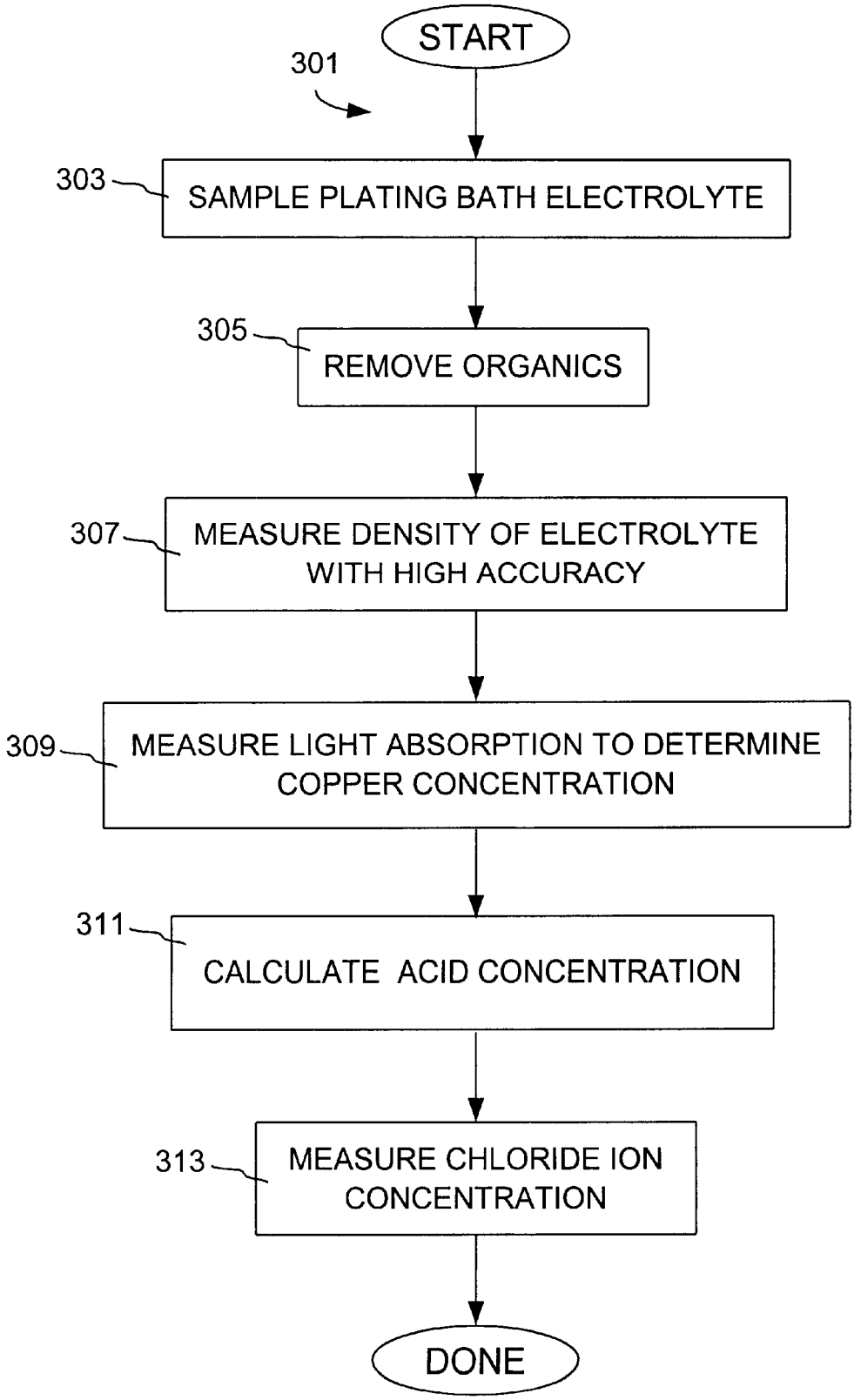
FIG. 3 is a flowchart of a method of the invention for on-line determination of metal, acid, and chloride ion constituents of a plating process.

FIG. 3 is a flowchart of a method, 301, of the invention for on-line determination of metal, acid, and chloride ion constituents of a plating process in accordance with apparatus depicted in FIG. 1 and FIG. 2. Method 301 begins with sampling plating bath electrolyte as previously described. See 303. Then essentially all organic components of the electrolyte are removed. See 305. Preferably this is done via filtration, but other processes may be employed in the method. Next, an accurate density measurement of the electrolyte is obtained at 307. Then the copper concentration is determined using, in this case, a spectrophotometer. The acid concentration is then calculated using the density and copper concentration values. See 311. Finally, the chloride ion concentration is measured at block 313. Using method 301, accurate concentration values can be obtained easily using an on-line flow through analysis system 101.

Figure 4:
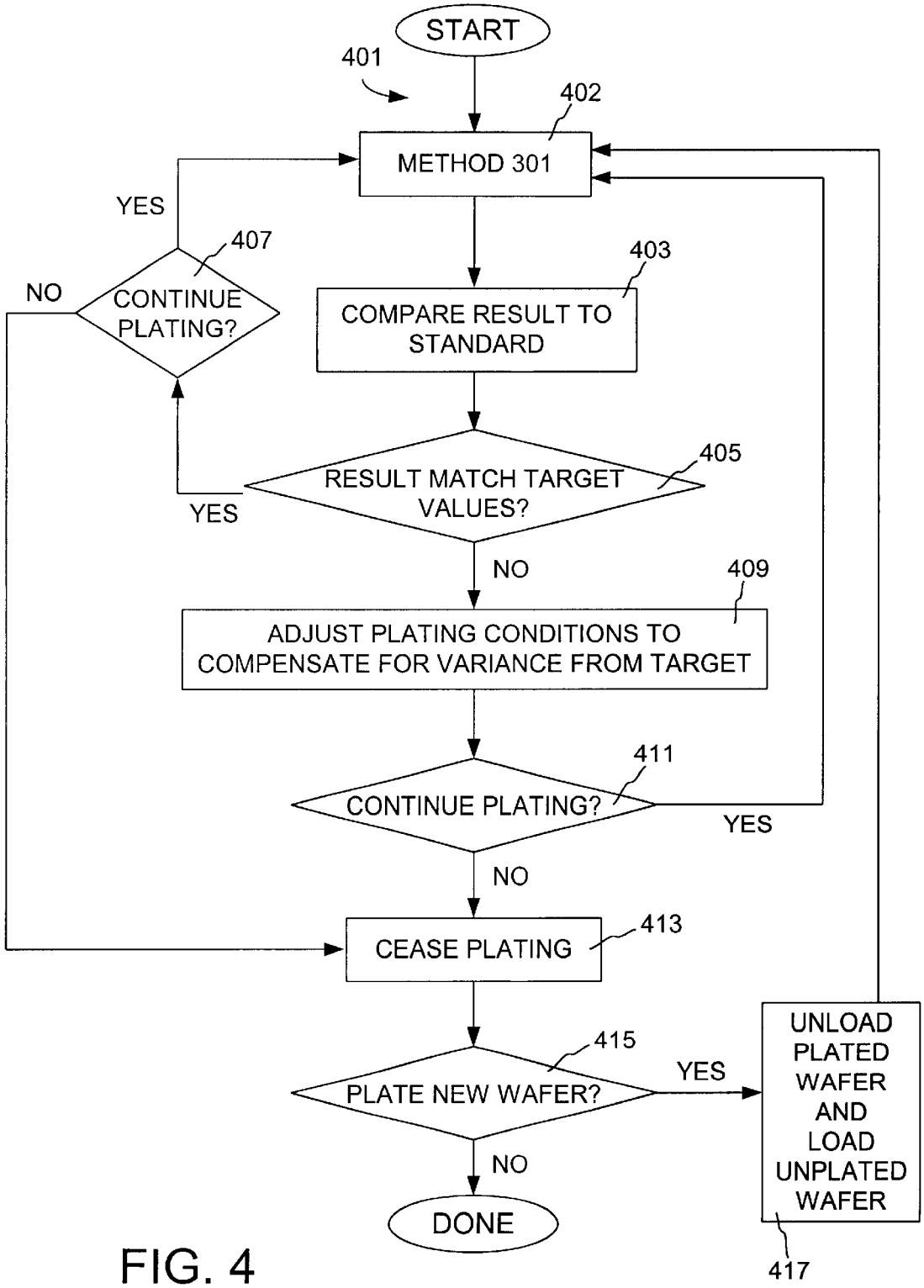
FIG. 4 is a flowchart of the monitoring and feedback control method of the invention as it relates to FIG. 3.

When combined with associated logic, method 301 can be used to assay bath constituent concentrations in order to determine whether or not to initiate plating, or to control an ongoing plating process. FIG. 4, depicts a method 401, which uses method 301 along with associated logic to monitor and control an electroplating process (also in accordance with apparatus depicted in FIG. 1 and FIG. 2). Method 401 starts at block 402 with method 301 (from FIG. 3). After the concentrations of metal, acid, and chloride have been determined (together forming a result), the result is compared to a standard. See 403. The standard contains target (desired) values for each of the metal, acid, and chloride concentrations. Of course each of the desired values can be a specified range of acceptable concentrations for each of the metal, acid, and chloride. Next in block 405, a decision is made as to whether the result matches a desired target result. If the spectral result matches the target result, then another decision is made whether to continue plating, see block 407. If plating is to continue (based on a timer, or other process monitoring such as amount of metal plated, etc.) then blocks 402–407 are repeated until such time that the plating is deemed finished. In a typical system, a new analysis (402–407) is generated from the plating bath electrolyte every 0.3 to 10 minutes. If plating is deemed finished at block 407, then the plating process is stopped. See block 413. Cessation of plating can mean any plating hardware manipulation that achieves that end. Preferably, plating current is stopped and the wafer and counter electrode are moved away from each other. Once plating is ceased, the logic queries whether a new wafer (or set of wafers depending upon the application) is to be plated, see 415. If not, the method is done. If so, the fully processed wafer (or wafers) is unloaded and an unplated wafer is loaded, see 417. Once the new wafer is loaded, the method begins again at block 402.

Returning to decision block 405, if the result does not match the target result, then the system controller (for example computer 223, FIG. 2) commands the hardware to adjust the plating conditions to compensate for the variance from the target result. See 409. Any number of manipulations of the bath chemistry hardware or plating hardware can achieve this. For example a plating bath electrolyte formulation may be adjusted, or a plating current level may be adjusted to decrease or increase consumption of copper ions.

After adjustment of the plating conditions, the system determines whether plating should continue. See 411. It is possible that the comparison of the analysis result with the standard (block 405) indicates that conditions have degraded to a point where the wafer must be scrapped or specially treated in some manner to reach an acceptable state for further processing. If it is determined at 411 that plating is not to continue, then plating is ceased and so on as described above, see 413–417. In 411, if plating is to continue, then process control returns to blocks 402–407.

As mentioned, the standard contains target (desired) values for each of the metal, acid, and chloride concentrations that correspond to an optimal bath formulation for the desired plating results. The target values can also be a specific range of concentrations for each of the metal, acid, and chloride that correspond to an optimal bath formulation for the desired plating results. Typically, the result does not match the standard exactly, but rather should match within a range of concentrations of the bath constituents in question. In this way, concentrations of the bath constituents can be adjusted accordingly, via commands to the bath chemistry hardware. In an alternative embodiment, HPLC analysis of a removed organic fraction from the electrolyte (FIG. 3, block 305) is added to method 301 and the concentration values for organic bath constituents (as compared to target values) is also used as a basis for the control logic in method 401.

Embodiments of the present invention employ various processes involving data stored in or transferred through one or more computer systems. Embodiments of the present invention also relate to the apparatus for performing these operations. These apparatus and processes may be employed to monitor plating bath constituents, retrieve stored spectra from databases or other repositories, and adjust the bath constituents or plating hardware. The control apparatus of this invention may be specially constructed for the required purposes, or it may be a general-purpose computer selectively activated or reconfigured by a computer program and/or data structure stored in the computer. The processes presented herein are not inherently related to any particular computer or other apparatus. In particular, various general-purpose machines may be used with programs written in accordance with the teachings herein, or it may be more convenient to construct a more specialized apparatus to perform the required method steps.

In addition, embodiments of the present invention relate to computer readable media or computer program products that include program instructions and/or data (including data structures) for performing various computer-implemented operations. Examples of computer-readable media include, but are not limited to, magnetic media such as hard disks, floppy disks, and magnetic tape; optical media such as CD-ROM disks; magneto-optical media; semiconductor memory devices, and hardware devices that are specially configured to store and perform program instructions, such as read-only memory devices (ROM) and random access memory (RAM). The data and program instructions of this invention may also be embodied on a carrier wave or other transport medium. Examples of program instructions include both machine code, such as produced by a compiler, and files containing higher level code that may be executed by the computer using an interpreter.

Figure 5:
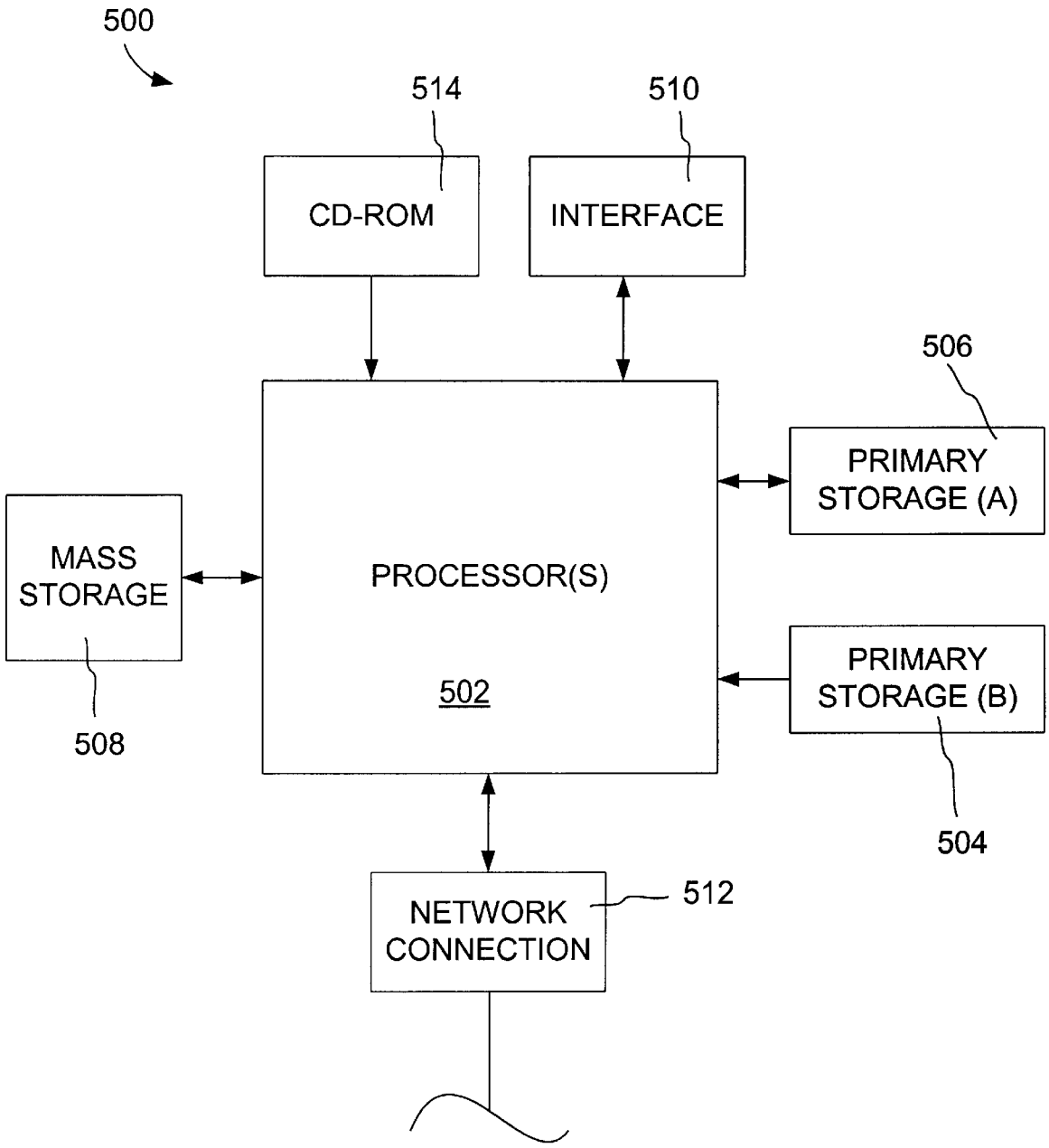
FIG. 5 is a block diagram of a computer system that may be used to implement various aspects of this invention such as manipulating data from the on-line analysis system and using this information to provide feedback to an electroplating apparatus.

FIG. 5 illustrates a typical computer system that, when appropriately configured or designed, can serve as a system controller of this invention. The computer system 500 includes any number of processors 502 (also referred to as central processing units, or CPUs) that are coupled to storage devices including primary storage 506 (typically a random access memory, o r RAM), primary storage 504 (typically a read only memory, or ROM). CPU 502 may be of various types including microcontrollers and microprocessors such a s programmable devices (e.g., CPLDs and FPGAS) and unprogrammable devices such as gate array ASICs or general purpose microprocessors. As is well known in the art, primary storage 504 acts to transfer data and instructions uni-directionally to the CPU and primary storage 506 is used typically to transfer data and instructions in a bi-directional manner. Both of these primary storage devices may include any suitable computer-readable media such as those described above. A mass storage device 508 is also coupled bi-directionally to CPU 502 and provides additional data storage capacity and may include any of the computer-readable media described above. Mass storage device 508 may be used to store programs, data and the like and is typically a secondary storage medium such as a hard disk. It will be appreciated that the information retained within the mass storage device 508, may, in appropriate cases, be incorporated in standard fashion as part of primary storage 506 as virtual memory. A specific mass storage device such as a CD-ROM 514 may also pass data uni-directionally to the CPU.

CPU 502 is also coupled to an interface 510 that connects to one or more input/output devices such as such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 502 optionally may be coupled to an external device such as a database or a computer or telecommunications network using an external connection as shown generally at 512. With such a connection, it is contemplated that the CPU might receive information from the network, or might output information to the network in the course of performing the method steps described herein.

Typically, the computer system 500 is directly coupled to a mass spectrometer and other components of a electroplating apparatus of this invention. For example, the computer system of FIG. 5 may correspond to the computer 223 depicted in FIG. 2. Data from a mass spectrometer is provided via interface 510 for analysis by system 500. With this data, the apparatus 500 can issue various control commands such as adjusting plating bath formulations or cessation of plating.

While this invention has been described in terms of a few preferred embodiments, it should not be limited to the specifics presented above. Many variations on the above-described preferred embodiments may be employed. Therefore, the invention should be broadly interpreted with reference to the following claims.

What is claimed is:

1. A method for monitoring and controlling an electroplating process, the method comprising:

(a) obtaining a sample of electrolyte, comprising an acid, a metal salt, and one or more organic components, from the electroplating process;

(b) removing an organic fraction of the sample of electrolyte to give a substantially organic-free electrolyte sample;

(c) determining the density of the substantially organic-free electrolyte sample;

(d) determining at least one of the conductivity and the light absorption of the substantially organic-free electrolyte sample;

(e) comparing at least one of the conductivity and the light absorption measurement of the substantially organic-free electrolyte sample with the density in order to determine a concentration value for each of the metal salt and the acid; and (f) adjusting conditions of the electroplating process in response to a comparison of the concentration value for each of the metal salt and the acid, with an associated target value.

2. The method of claim 1, wherein the sample of electrolyte is obtained directly from a plating cell of the electroplating process.

3. The method of claim 1, wherein the sample of electrolyte is obtained directly from a separate sampling vessel of the electroplating process.

4. The method of claim 1, wherein the metal salt is a copper salt.

5. The method of claim 4, wherein the copper salt is copper sulfate.

6. The method of claim 1, wherein the acid is sulfuric acid.

7. The method of claim 1, further comprising determining a chloride ion concentration measurement for the substantially organic-free electrolyte sample before (f), wherein (f) further includes an adjustment of the electroplating process with respect to a comparison of the chloride ion concentration measurement with an associated target value.

8. The method of claim 1, wherein removing an organic fraction of the sample of electrolyte includes a filtration.

9. The method of claim 8, wherein a charcoal medium is used for the filtration.

10. The method of claim 8, wherein molecular sieves are used for the filtration.

11. The method of claim 1, wherein (b) further comprises an HPLC analysis of the organic fraction, and wherein (f) further includes an adjustment of the electroplating process with respect to a comparison of at least one concentration of an organic bath constituent, obtained from the HPLC analysis, with a target concentration value for the organic bath constituent.

12. The method of claim 1, wherein adjusting conditions of the electroplating process comprises adjusting electroplating apparatus hardware.

13. The method of claim 12, wherein adjusting electroplating apparatus hardware comprises adjusting an electrolyte composition.

14. The method of claim 12, wherein adjusting electroplating apparatus hardware comprises adjusting an electrical current flow.

15. The method of claim 12, wherein adjusting electroplating apparatus hardware comprises adjusting a field shaping apparatus.

16. The method of claim 12, wherein adjusting electroplating apparatus hardware comprises adjusting a voltage level.

17. The method of claim 12, wherein adjusting electroplating apparatus hardware comprises adjusting a wafer handling apparatus.

18. The method of claim 12, wherein adjusting electroplating apparatus hardware comprises adjusting a relative orientation of an electrode with a counter electrode.

19. The method of claim 1, further comprising returning the substantially organic-free electrolyte sample to a central chemistry vessel of the electroplating process.

20. The method of claim 1, wherein (a)–(f) comprise an analysis and said analysis occurs at regular time intervals of between about 0.3 and 10 minutes.

21. An apparatus for controlling an electroplating process, the apparatus comprising:

(a) a device for sampling electrolyte from the electroplating process, wherein the electrolyte comprises an acid, a metal salt, and one or more organic components;

(b) a module for removing an organic fraction from the electrolyte to give a substantially organic-free electrolyte sample;

(c) a densimeter for determining a density of the substantially organic-free electrolyte sample;

(d) a module for determining at least one of conductivity and light absorption for the substantially organic-free electrolyte sample; and (e) an associated logic for:

(i) using at least one of the conductivity and the light absorption in the substantially organic-free electrolyte sample and the density measurement in order to determine a concentration value for each of the acid and the metal salt;

(ii) controlling the electroplating process based on comparison of the concentration value for each of the metal salt and the acid, with an associated target value.

22. The apparatus of claim 21, wherein the device for sampling electrolyte is a pump.

23. The apparatus of claim 21, wherein the device for sampling electrolyte collects electrolyte directly from a plating bath of the electroplating process.

24. The apparatus of claim 21, wherein the device for sampling electrolyte collects electrolyte from a separate sampling vessel that receives electrolyte from a plating bath of the electroplating process.

25. The apparatus of claim 21, wherein the device for sampling electrolyte delivers electrolyte at between about 1 and 20 ml/minute.

26. The apparatus of claim 21, wherein the module for removing an organic fraction from the electrolyte is a filter that uses a charcoal medium as an organic adsorbant.

27. The apparatus of claim 21, wherein the module for removing an organic fraction from the electrolyte is a filter that uses molecular sieves as an organic adsorbant.

28. The apparatus of claim 21, further comprising an HPLC module, wherein the module for removing an organic fraction from the electrolyte isolates the organic fraction for the HPLC module.

29. The apparatus of claim 21, wherein the densimeter measures density of the electrolyte sample to within an accuracy of 0.0001 $g/cm^3$.

30. The apparatus of claim 21, wherein the associated logic determines the concentration value for each of the metal salt and the acid to within an accuracy of 0.1 g/L.

31. The apparatus of claim 21, wherein the module for determining at least one of conductivity and light absorption comprises a conductivity measuring device.

32. The apparatus of claim 21, wherein the module for determining at least one of conductivity and light absorption comprises a dual beam fiber optic spectrophotometer.

33. The apparatus of claim 21, wherein the module for determining at least one of conductivity and light absorption comprises both a dual beam fiber optic spectrophotometer and a conductivity measuring device.

34. The apparatus of claim 21, further comprising a module for determining a chloride ion concentration from the substantially organic-free electrolyte sample, wherein the chloride ion concentration is also used as a basis for controlling the electroplating process by the associated logic.

35. The apparatus of claim 34, wherein determining the chloride ion concentration involves electrochemical oxidation of chloride ion to chlorine gas.

36. The apparatus of claim 21, further comprising a feed line for returning the substantially organic-free electrolyte sample to a central chemistry vessel of the electroplating process.

* * * * *